US006719494B1

(12) United States Patent
Machin

(10) Patent No.: US 6,719,494 B1
(45) Date of Patent: Apr. 13, 2004

(54) CABLE AND PIPE BURIAL APPARATUS AND METHOD

(75) Inventor: Jonathan B. Machin, North Palm Beach, FL (US)

(73) Assignee: Coelexip, S.A. (FR)

( * ) Notice: Subject to any disclaimer, the term of this patent is extended or adjusted under 35 U.S.C. 154(b) by 0 days.

(21) Appl. No.: 09/692,591

(22) Filed: Oct. 19, 2000

(51) Int. Cl.[7] ..... E02F 5/10
(52) U.S. Cl. ..... 405/163; 405/160; 37/344
(58) Field of Search ..... 405/164, 163, 405/160, 159, 158; 37/322, 323, 342, 344

(56) References Cited

U.S. PATENT DOCUMENTS 3,786,642 A * 1/1974 Good et al. ..... 405/163
4,037,422 A * 7/1977 DEBoer et al. ..... 405/163
4,087,981 A * 5/1978 Norman ..... 405/163
4,117,689 A * 10/1978 Martin ..... 405/163
4,274,760 A * 6/1981 Norman ..... 405/163
4,389,139 A * 6/1983 Norman ..... 405/163
4,479,741 A * 10/1984 Berti et al. ..... 405/163
4,586,850 A * 5/1986 Norman et al. ..... 405/163

FOREIGN PATENT DOCUMENTS

GB 2058883 * 4/1981 ..... 405/163

* cited by examiner

*Primary Examiner*—Frederick L. Lagman
(74) *Attorney, Agent, or Firm*—Ostrolenk, Faber, Gerb & Soffen, LLP

(57) ABSTRACT

An apparatus for burying cables and pipes in soil includes a support structure adapted for movement across a surface of the soil. A water jetting machine is provided for producing a source of pressurized water. At least two jetting arms are in fluid communication with the source of pressurized water. The jetting arms have vertical adjustment structure for varying at least the vertical position of each jetting arm relative to the support structure so as to adjust for varying soil conditions. A method for burying cables and pipes in soil is also disclosed.

21 Claims, 4 Drawing Sheets

CABLE AND PIPE BURIAL APPARATUS AND METHOD

FIELD OF THE INVENTION

This invention relates generally to cable and pipe burial apparatus, and more particularly to jetting tools for cable and pipe burial.

BACKGROUND OF THE INVENTION

The growing demand for international voice and/or data transmission has created the need for more underwater cables to carry this information across the seas. Cables are typically laid in trenches in order to protect the cable from damage and to resist unwanted movement of the cable, which can also result in damage. These trenches have been created primarily by two types of machines, plows and jetting systems. Plows are mechanical devices which are remotely operated and dragged or otherwise propelled across the sea floor. A plow blade extends into the sea floor and creates the trench as the plow is moved. The cable is typically laid simultaneously in the trench that is formed behind the plow. These plows are difficult to operate in deep water, although plows are currently preferred for longer runs. Water jetting systems are preferred in deep water systems.

Trenches for cable and pipes are often excavated in the ground or sea floor using water jetting machines. These machines are equipped with water discharge nozzles mounted on jetting arms. The jetting arms allow the nozzles to shape an approximately vertical sided "U" shaped trench in which to bury the cable or pipe. The jetting arms straddle the cable and, as the trenches form, the cable drops in the trench. Jetting is sensitive to the type and strength of soils. These machines typically have a relatively narrow range of soil conditions in which the jetting systems operate efficiently. The nozzles are mounted at fixed points on the jetting arms. The energy requirement of the excavation process in any given soil condition depends on the water discharged through the nozzles, and the spacing between the nozzles on the arms. The jet is created by a motor which typically has constant speed. The discharge nozzle diameter is difficult to adjust under these conditions, as is the spacing between the nozzles on the arms. Consequently, current jetting machines are severely limited in their ability to operate in variable soil conditions.

Variable soil conditions are encountered frequently in the sea floor. Packed soils containing aggregates are more difficult to remove by water jets than are looser, fine soils. These differing soil conditions from trenches require different jetting characteristics in order to adjust efficiently and effectively. It has proven difficult, however, to make these adjustments. The ability of water jetting equipment to make a trench in any given soil type which may be encountered depends on the power available, water discharge through the nozzles, and the spacing between the nozzles on the arms. Consequently, when the energy available, water discharge and nozzle spacings are all fixed the machine is limited in its ability to operate in varying soil conditions. It is currently uneconomical to manufacture machines with variable energy and water discharge capability. The productivity of these machines tends to reduce dramatically when soil conditions vary from those assumed in design, which is frequently the case.

Many cables and pipes are laid in tight loops on the sea floor prior to burial. This requires the jetting machine to turn frequently. Current jetting systems typically rotate the entire jetting arm around a single hinged point as a means for altering trench depth. This restricts the ability of the jetting machine to turn efficiently.

It is preferable to alter the trench depth as soil conditions vary. Stronger soils afford greater protection, and a shallower trench is necessary than where soils are weaker, and thus where burial must be deeper. A uniform level of protection against an aggressive strike with varying trench depth in varying soil strength is known as the Burial Protection Index (BPI) and is discussed by Mole, et al., "Cable Protection-Solutions Through New Installation and Burial Approaches," Suboptice 1997, San Francisco, May, 11–16 1997. The BPI is a measure of the level of protection which must be afforded against different physical threats to the cable or pipe, such as trawling or anchors. More vigorous threats, such as anchors, require a higher BPI. Different soils provide the same BPI number at different trench depths. Stronger soils generally provide the same BPI protection with a shallower trench depth than do weaker soils.

Obstructions are sometimes encountered by burial systems. Accordingly, it is known to make nozzles retractable in case of obstructions. Such a system is shown in FIGS. 2A and 2B. The nozzles 10, 18 and 24 are provided on the jetting assembly 14. The nozzle 24 is typically extended by assembly 28, while the nozzles 10 and 18 are fixed in position. Only the position of the nozzle 24 is adjustable. Retraction of the assembly 28 is possible from the position shown in FIG. 2B to the position shown in FIG. 2A in the event that an obstruction is encountered. The vertical position of the nozzles 10 and 18 is not adjustable, and accordingly, this system is not useful to vary the depth of the trench that is formed.

BRIEF SUMMARY OF THE INVENTION

An apparatus for burying cables and pipes in soil includes a support structure adapted for movement across a surface of the soil. A source of pressurized water is provided. At least two jetting arms in fluid communication with the source of pressurized water have vertical position adjustment structure for varying at least the vertical position of each jetting arm relative to the support structure. The vertical position adjustment structure is preferably independently adjustable.

At least two vertically adjustable jetting arms are preferably aligned as a row substantially in the direction of movement of the support structure. First and second rows of the vertically adjustable jetting arms are most preferably provided and are laterally spaced at a distance to result in the desired trench width.

A method for burying cables and pipes in soils comprises the steps of moving at least two water jets across the sea floor and independently varying the vertical height of the water jets depending on soil conditions. In a preferred embodiment, at least two rows of jets are provided in spaced relation to define a trench width. The cable is dropped into the trench behind the jets.

BRIEF DESCRIPTION OF THE DRAWINGS

There are shown in the drawings embodiments which are presently preferred, it being understood, however, that the invention is not limited to the precise arrangements and instrumentalities shown, wherein.

DETAIL DESCRIPTION OF THE PREFERRED EMBODIMENT

Figure 1:
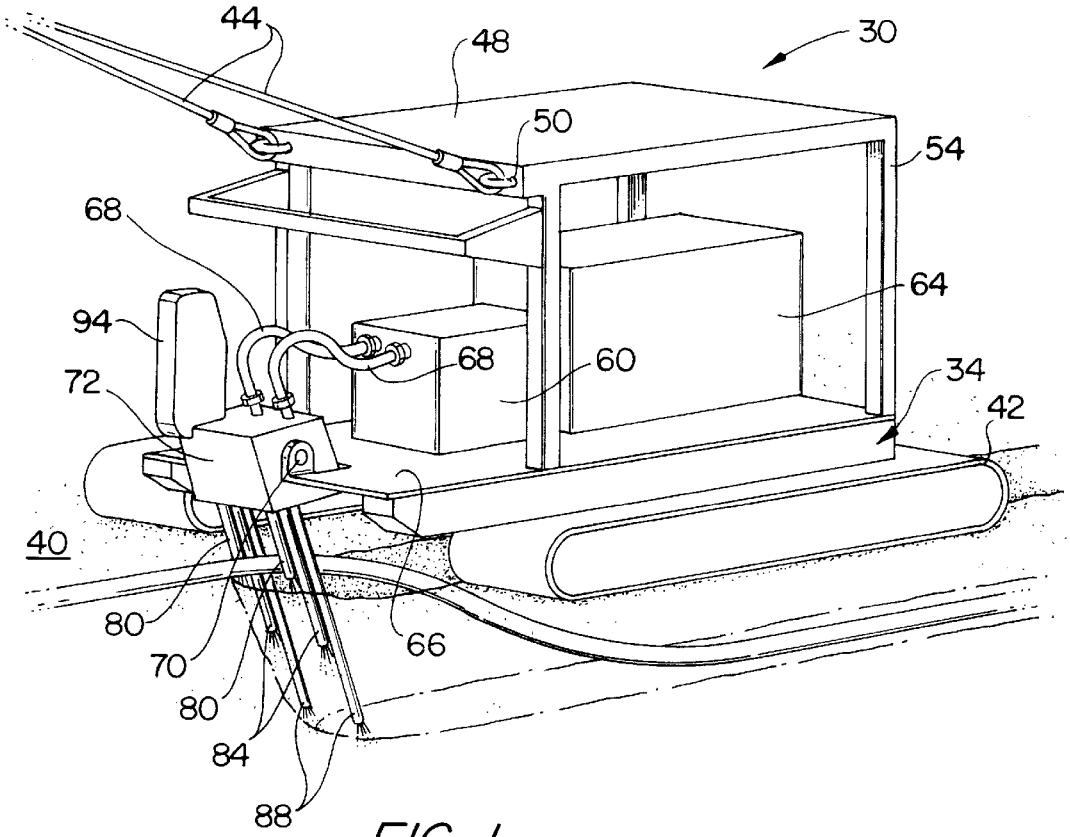
FIG. 1 is a perspective view of a cable burial apparatus according to the invention.
Figure 2A:
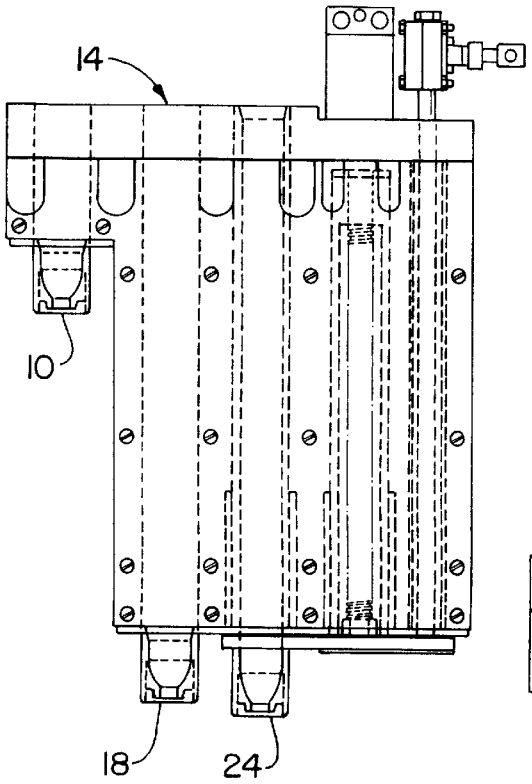
FIG. 2A (PRIOR ART)
FIG. 2A is a side elevation of a prior art jetting system in a first mode of operation.
Figure 2B:
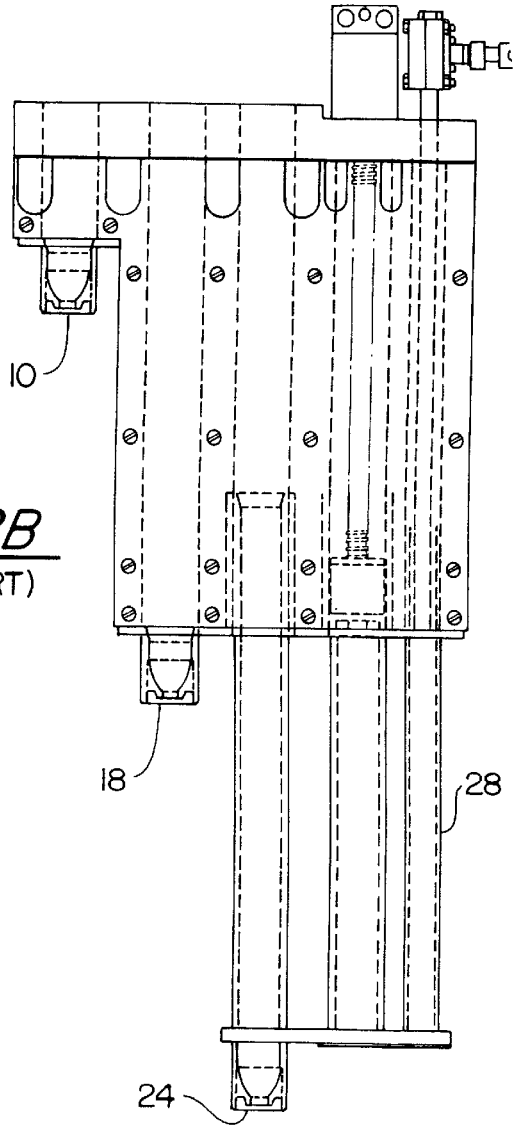
FIG. 2B (PRIOR ART)
FIG. 2B is a side elevation of the jetting system in FIG. 2A which is shown in a second mode of operation.

There is shown in FIG. 1 a cable burial apparatus 30 according to the invention. The cable burial apparatus 30 includes a support structure 34. The support structure 34 is adapted for movement across the sea floor 40 and has suitable structure therefore such as rotatable treads 42 or skids. Towing cables 44may be attached to clasps 50 provided on housing 54. The structure for providing a source of pressurized water preferably includes a pump 60. The pump 60 is powered by a suitable motor 64. The pump 60 supplies pressurized water through lines 68 to a jetting arm assembly 72. The jetting arm assembly 72 can be mounted to the platform 66 by suitable structure such as the pivotal mounting 70. A plurality of jetting arms are provided on the jetting arm assembly 72. In the embodiment that is shown in FIG. 1, three jetting arms are provided on each lateral side of the jetting arm assembly 72, although more or fewer jetting arms are possible. At each lateral side of the jetting arm assembly 72 there is a forward jetting arm 80, middle jetting arm 84, and third jetting arm 88. In the embodiment shown in FIG. 3, a fourth jetting arm 90 is provided rearward of the third jetting arm 88.

The jetting arms are vertically adjustable relative to the jetting arm assembly 72. The construction of the jetting arms can vary. In one embodiment, the jetting arms are mechanically actuated and slide into the assembly 72 according to an appropriate signal. In another embodiment, the jetting arms can be made to be telescoping tubes which are extended by drive structure. The drive structure can be any suitable structure, such as mechanical or electrical actuators. The drive structure 5 can be located in a housing 94.

Each of the adjustable jetting arms preferably has an independent actuating mechanism such that the vertical position of the jetting arm is independently adjustable relative to the other jetting arms. The jetting arms positioned at or near the surface of the soil need not necessarily be adjustable since the position of the device relative to the surface is not likely to change substantially. Corresponding jetting arms on each lateral side of the jetting assembly 72 will typically be positioned at the same vertical position so that the trench that is formed is substantially symmetrical. This is not strictly necessary, however, and in some instances, such as during turns, it is desirable that the jetting arms at one lateral side be higher in vertical position than the jetting arms at the other lateral side.

Figure 3A:
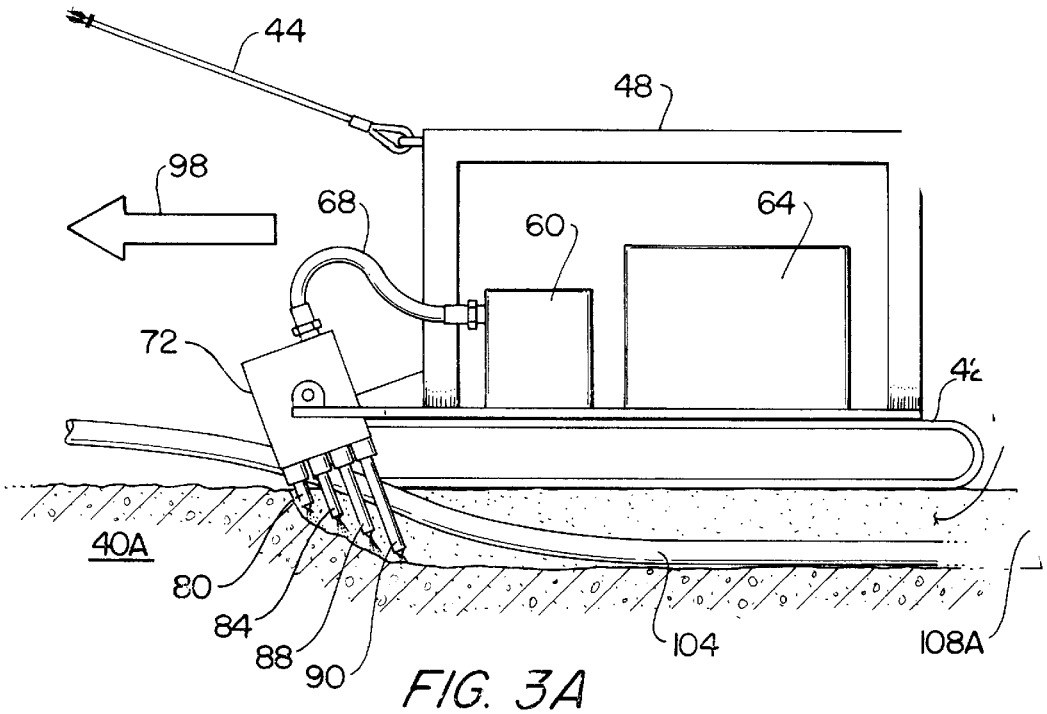
FIG. 3A is a side elevation, partially in cross section, of a cable burial apparatus according to the invention in a first mode of operation for a first soil condition.
Figure 3B:
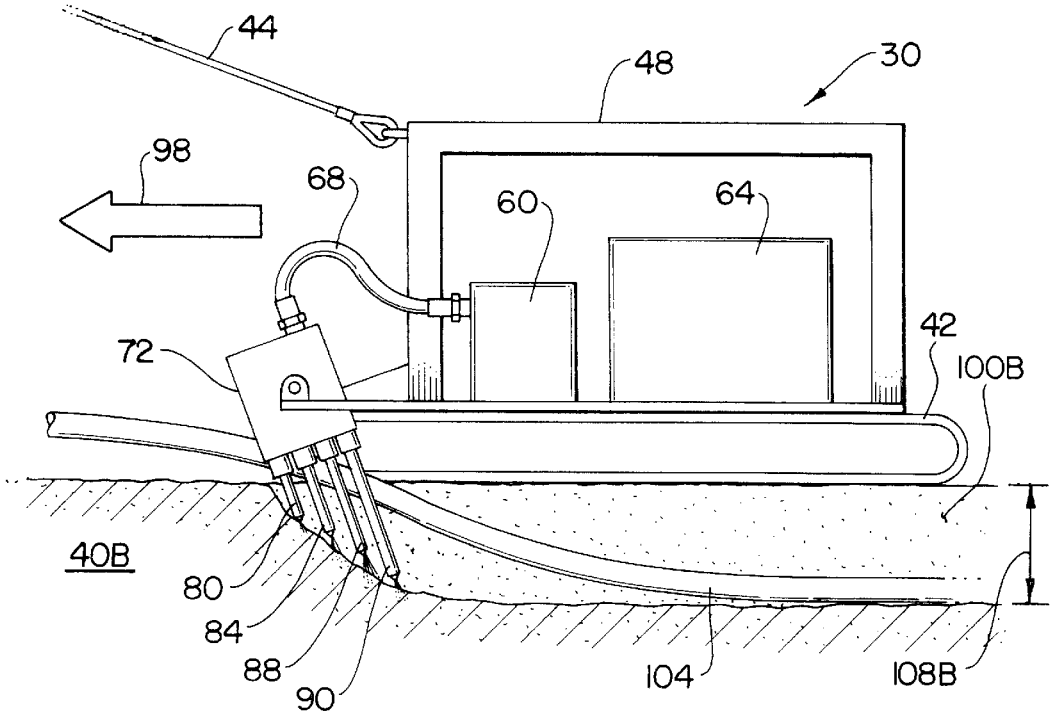
FIG. 3B is a side elevation, partially in cross section, in a second mode of operation for a second soil condition.

The operation of the burial apparatus 30 is shown in FIGS. 1 and 3. The burial apparatus 30 is moved in the direction of arrow 98. The jetting arms 80, 84, 88 and 90 are in a first position shown in FIG. 3A for use in strong soil 40A. It is seen that the forward-most jetting arm 80 is generally higher than the subsequent jetting arm 84, and that the next jetting arms 88 and 90 are progressively lower in order to arrive at the finished depth of the trench 100. The cable or pipe 104 is straddled by the two lateral rows of jetting arms and drops into the trench 100A behind the jetting arms at the first depth as shown by arrow 108A. Ancillary structures can be buried with the cable or pipe 104, such as anodes in the case of pipes or amplifiers and repeaters in the case of cables. A weaker soil 40B is shown in FIG. 3B. The weaker soil requires a deeper trench 100B as shown by arrow 108B. The deeper trench is required in order to afford the same protection to the cable 104 according to the Burial Protection Index (BPI). The jetting arms 80, 84, 88 and 90 are extended by the actuator to reach depth appropriate to the strength of the soil.

Figure 4A:
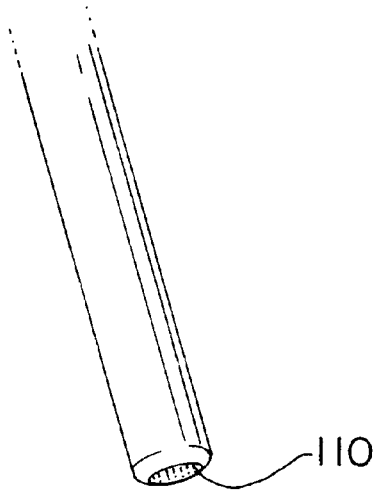
FIG. 4A is a view of an embodiment of nozzle according to the invention.
Figure 4B:
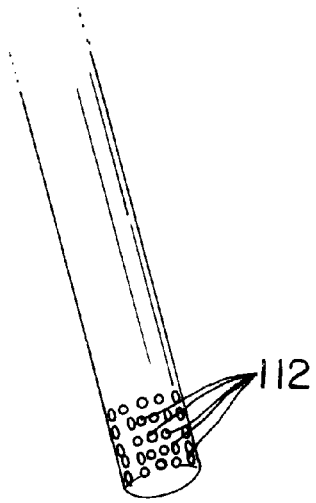
FIG. 4B is a view of an alternative embodiment of nozzle according to the invention.
Figure 4C:
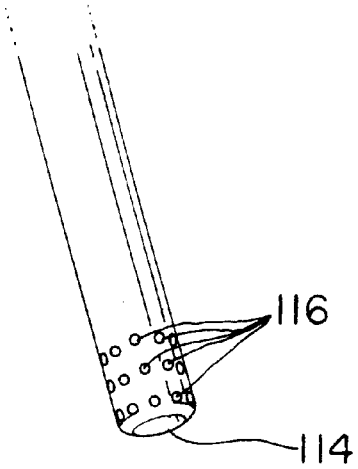
FIG. 4C is a view of a further embodiment of nozzle according to the invention.

The jetting arms 80, 84, 88 and 90 are preferably provided with one large diameter nozzle 110 substantially at the end of each jetting arm, as shown in FIG. 4A. It is alternatively possible as illustrated in FIG. 4B that each jetting arm have a plurality of smaller diameter nozzles 112. FIG. 4C shows a further embodiment having a large diameter nozzle 114 at the lower end of the jetting arm and a plurality of smaller diameter nozzles 116. These nozzles should preferably be positioned substantially at the end of each jetting arm, or on the lower end of each jetting arm, such that the nozzles will not be obstructed if the jetting arm is raised. The nozzles are preferably provided on the lower one-third of the length of the jetting arm. Also, the nozzles should be positioned such that the water flow from the nozzles on one jetting arm does not interfere with the water flow from the nozzles on another jetting arm. A large diameter nozzle preferably jets substantially downward, while the smaller diameter nozzles can jet in several different directions, to the sides and downward. The jetting arms can all be adjustable, however, it is alternatively possible that one or more of the jetting arms, such as at the front, is fixed in position and the remaining arms are adjustable.

The control system for the burial device 30 can be adjusted depending on known soil conditions. It is alternatively possible, however, to perform one or more soil strength tests in advance of the burial device 30 or by monitoring the trench depth. The relative spacing between adjacent nozzles on the jetting arms and the vertical position of the nozzles can be operator controlled, or an automatic control system can be provided. For example, a load sensor can be used to determine soil resistance imposed on the jetting arms and the vertical position and/or spacing of the nozzles can be adjusted based upon this information.

The invention is capable of taking other specific forms without departing from the spirit or essential attributes thereof, and accordingly, reference should be had to the following claims, rather than to the foregoing specification, as indicating the scope of the invention.

I claim:

1. An apparatus for burying cables and pipes in soil, comprising:

a support structure adapted for movement across a surface of the soil;

a source of pressurized water;

at least two jetting arms in fluid communication with said source of pressurized water and having vertical adjustment structure for varying at least the vertical position of each jetting arm relative to the support structure; and a control system, which control system is adjustable during said movement depending on soil conditions, said control system linked to said vertical adjustment structure of said jetting arms so as to vary the vertical position of each jetting arm as a trench is cut to vary the depth of trench created depending on the soil conditions, wherein said control system is operable for performing a soil strength test during said moving step.

2. The apparatus of claim 1, wherein the at least two vertically adjustable jetting arms are aligned as a row substantially in the direction of movement of said support structure.

3. The apparatus of claim 2, further comprising first and second rows of vertically adjustable jetting arms, said first and second rows being substantially parallel.

4. The apparatus of claim 1, wherein said vertical adjustment structure for each jetting arm is independent of the vertical adjustment structure for other jetting arms.

5. The apparatus of claim 1, wherein at least two jetting arms comprise said vertical adjustment structure and at least one jetting arm is substantially fixed in vertical position.

6. The apparatus of claim 5, wherein said fixed jetting arm is a front jetting arm.

7. The apparatus of claim 1, wherein at least one of said jetting arms comprises one large diameter nozzle at a lower end of said jetting arm.

8. The apparatus of claim 1, wherein at least one of said jetting arms comprises a plurality of small diameter nozzles substantially at a lower end of said jetting arm.

9. An apparatus for burying cables and pipes in soil, comprising:

a support structure adapted for movement across a surface of the soil;

a source of pressurized water;

at least two jetting arms in fluid communication with said source of pressurized water and having vertical adjustment structure for varying at least the vertical position of each jetting arm relative to the support structure;

a control system, which control system is adjustable depending on soil conditions, said control system linked to said vertical adjustment structure of said jetting arms so as to vary the vertical position of each jetting arm as a trench is cut to vary the depth of trench created depending on the soil conditions; and wherein at least one of said jetting arms comprises a large diameter nozzle at the lower end of said jetting arm and a plurality of smaller diameter nozzles substantially at a lower end of said jetting arm.

10. A method for burying cables and pipes in soils, comprising the steps of:

moving a water jetting apparatus across the surface of the soil, the water jetting apparatus comprising a source of pressurized water and having vertical adjustment structure for varying at least the vertical position of each jetting arm relative to the support structure; and during said moving step, adjusting the vertical position of said jetting arms as a trench is cut using a control system, which control system is adjustable depending on soil conditions, said control system linked to said vertical adjustment structure of said jetting arms so as to vary the depth of the trench, depending on soil conditions, said control system performing a soil strength test during said moving step.

11. The method of claim 10, wherein said jetting arms are positioned higher for stronger soils, and lower for weaker soils.

12. The method of claim 10, wherein said adjusting step for at least one jetting arm is independent of said adjusting step for at least one other jetting arm.

13. A method for burying cables and pipes in soils, comprising the steps of:

moving a water jetting apparatus across the surface of the soil, the water jetting apparatus comprising a source of pressurized water and having vertical adjustment structure for varying at least the vertical position of each jetting arm relative to the support structure; and during said moving step, adjusting the vertical position of said jetting arms as a trench is cut using a control system, which control system is adjustable depending on soil conditions, said control system linked to said vertical adjustment structure of said jetting arms so as to vary the depth of the trench, depending on soil conditions, wherein said control system performs said adjusting step automatically in response to said soil conditions.

14. The method of claim 13, wherein said control system automatically performs a soil strength test during said moving step.

15. The method of claim 14, wherein said control system automatically monitors a trench depth during said moving step.

16. The method of claim 13, wherein said control system automatically monitors a trench depth during said moving step.

17. A method for burying cables and pipes in soils, comprising the steps of:

moving a water jetting apparatus across the surface of the soil, the water jetting apparatus comprising a source of pressurized water and having vertical adjustment structure for varying at least the vertical position of each jetting arm relative to the support structure; and during said moving step, adjusting the vertical position of said jetting arms as a trench is cut using a control system, which control system is adjustable depending on soil conditions, said control system linked to said vertical adjustment structure of said jetting arms so as to vary the depth of the trench, depending on soil conditions, further comprising the step of providing at least one of said jetting arms with a large diameter nozzle at the lower end of said jetting arm and a plurality of smaller diameter nozzles substantially at a lower end of said jetting arm.

18. An apparatus for burying cables and pipes in soil, comprising:

a support structure adapted for movement across a surface of the soil;

a source of pressurized water;

at least two jetting arms in fluid communication with said source of pressurized water and having vertical adjustment structure for varying at least the vertical position of each jetting arm relative to the support structure; and a control system, which control system is adjustable during said movement depending on soil conditions, said control system linked to said vertical adjustment structure of said jetting arms so as to vary the vertical position of each jetting arm as a trench is cut to vary the depth of trench created depending on the soil conditions, wherein said control system performs said adjustment automatically in response to said soil conditions.

19. The apparatus of claim 18, wherein said control system automatically performs a soil strength test during said moving step.

20. The apparatus of claim 19, wherein said control system automatically monitors a trench depth during said moving step.

21. The apparatus of claim 18, wherein said control system automatically monitors a trench depth during said moving step.

* * * * *